US005188043A

United States Patent [19]

Trepaud

[11] Patent Number: 5,188,043

[45] Date of Patent: Feb. 23, 1993

[54] PROCESS AND APPARATUS FOR INCINERATING WASTE

[75] Inventor: Pierre Trepaud, Paris, France

[73] Assignee: Trepaud S.A., Paris, France

[21] Appl. No.: 809,020

[22] Filed: Dec. 17, 1991

[30] Foreign Application Priority Data

Jan. 14, 1991 [FR] France ..... 91 00322

[51] Int. Cl.[5] ..... F23G 5/00

[52] U.S. Cl. ..... 110/346; 110/165 R; 110/171; 110/259

[58] Field of Search ..... 110/165 R, 250, 259, 110/171, 346

[56] References Cited

U.S. PATENT DOCUMENTS

| | | | |
|---|---|---|---|
| 4,467,732 | 8/1984 | Taniguchi | 110/259 |
| 4,861,001 | 8/1989 | Schlienger | 110/250 X |
| 5,046,435 | 9/1991 | Kugler | 110/165 X |
| 5,050,512 | 9/1991 | Tratz et al. | 110/259 X |
| 5,078,065 | 1/1992 | Tsunemi et al. | 110/259 |

FOREIGN PATENT DOCUMENTS

| | | |
|---|---|---|
| 1394418 | 2/1965 | France . |
| 1560206 | 5/1965 | France . |
| 2647186 | 11/1990 | France . |

OTHER PUBLICATIONS

Revue Generale de Thermique-vol. n° 26, n° 310, Oct., 1987, Paris FR pp. 513-519; Aschard et al: 'Pour accroî tre les températures des flammes: brûleurs récupérateurs á gaz et électrobrûleurs'.

*Primary Examiner*—Edward G. Favors

*Attorney, Agent, or Firm*—Pearne, Gordon, McCoy & Granger

[57] ABSTRACT

The incinerator comprises a furnace (1) having a waste charging zone (2), an air insufflation intake (5), a smoke release outlet (8) and a discharge zone (10) for ash and unburnt material. The discharge zone (6) for ash and unburnt material communicates with the receiving hopper (10) of a bath equipped with an electroburner (12) intended to maintain the bath in the molten state.

9 Claims, 1 Drawing Sheet

PROCESS AND APPARATUS FOR INCINERATING WASTE

This invention relates to processes and apparatus for incinerating waste, comprising in particular substantial proportions of products which are difficult to destroy by simple combustion.

Therefore, residues are left which contain unburnt material which is frequently dangerous or which requires at least storage under so-called class I security conditions.

One solution, to do away with any unburnt matter, consists of raising the ash to a temperature which causes it to melt and vitrify, thus rendering the residue of the combustion completely inert. However, this requires elevated temperatures involving substantial energy expenditure.

The invention overcomes these disadvantages by allowing industrial or domestic waste to be raised to the temperatures needed to eliminate any unburnt matter whilst expending as little energy as possible.

The process for incinerating waste according to the invention consists in burning the waste in a furnace at a temperature of about 1000° to 1300° C. in order to obtain smoke and ash and unburnt matter. The process consists in passing the ash and unburnt matter into a bath of ash and unburnt matter maintained in the molten state by the heat released by an electroburner.

The bath of ash and unburnt matter which is heated, for example, to a temperature of at least 1500° C. and more particularly 1700° C. allows the heat supplied by the electroburner to be stored and transmitted by conduction, in a very effective manner, to the waste falling into the bath. The calorific mass of the bath makes it possible to even out the differences in quantity of heat required by the composition and by the variable influx of waste into the bath. Furthermore, this bath has a relatively large surface area to which the heat radiated by the electroburner is transmitted highly efficiently, particularly when the burner is arranged so that its flame extends close to the surface of the bath.

An electroburner is a gas burner supplied with electrical energy and is comprised of a device for injecting fuel gas along the axis of annular delivery means delivering a rotating air stream and is further comprised of an upstream electrode and a counter electrode connected together via main current source placed in a burnt gas reception chamber, an upstream electrode is placed along the axis of the annular means and arranged for creating an energy supply arc through the flame of the burner. The gas burner described in French patent application 89 06 560 (which corresponds to U.S. Pat. No. 5,088,917) is essentially that which is described above but adds a deflector plate placed in the path of combustion air steam, close to the upstream electrode, and means providing an arc ignition voltage across the upstream electrode and the deflector.

To reduce the ignition voltage, the deflector is advantageously formed as an electrically conducting disc having a surface confronting the upstream electrode and a distance there from between 1–3 mm. A voltage of a few thousand volts (e.g. 3000 volts) is then sufficient to cause ionization and initiate discharge. With this system, the gas can be ignited with the combustion.

The flame obtained by the combustion of natural gas with cold air in stoichiometric conditions is at a temperature of the order of 1450° C. With the calorific input supplied by the electric arc, the temperature rises and may reach 2700° C. The flame obtained is large and has very considerable radiation energy, thus allowing the heat to propagate as far as the free surface area of the bath, unlike focussed heating apparatus of the plasma type.

The invention also relates to a waste incinerator comprising a furnace having a waste charging zone, an air insufflation intake, a smoke release outlet and a zone for discharging ash and unburnt matter. The zone for discharging ash and unburnt matter communicates with the receiving hopper of a bath supplied with an electroburner intended to maintain the bath in the molten state.

According to a preferred embodiment, the hopper is below the furnace and the furnace has, in the discharge zone, an inclined plane connected to the hopper. The waste then merely has to be pushed into the charging zone in order to push it gradually, after it has undergone primary combustion, onto the inclined plane down which it slides and eventually falls into the bath. To enable the incinerator to operate automatically, it is also envisaged that the bath should empty into a water tank through an overflow. The quantity of bath is thus automatically limited and the molten ash and unburnt material are vitrified in the usual way. To prevent the bath from solidifying, close to the overflow, the electroburner is arranged closer to the overflow than to the inclined plane. The overflow also serves as an obstacle to prevent waste from passing directly into the tank.

According to a particularly preferred embodiment, the incinerator has means for determining the quantity of heat required to be supplied by the electroburner, for example an indicator of the intake rate of waste or, preferably, a probe indicating the bath temperature, preferably a pyrometric probe. A control circuit for the device for supplying electrical energy to the electroburner as a function of the signal emitted by the means for determining the quantity of heat to be supplied by the electroburner is provided. As a result of the stabilisation of the temperature of the ash by the buffer effect of the bath and the possibility of controlling the apparatus for supplying electrical energy to the electroburner virtually instantaneously, because the control is carried out by electrical means, it is possible to control the supply of calorific energy in a way which corresponds exactly to what is required in order to burn the unburnt matter without using excess calorific energy. Thus, everything combines to achieve the combustion at the lowest cost in energy, since the additional high-temperature electrical energy of the electroburner is utilised to the optimum degree.

In the accompanying drawings, given solely by way of example:

Figures 1, 2:
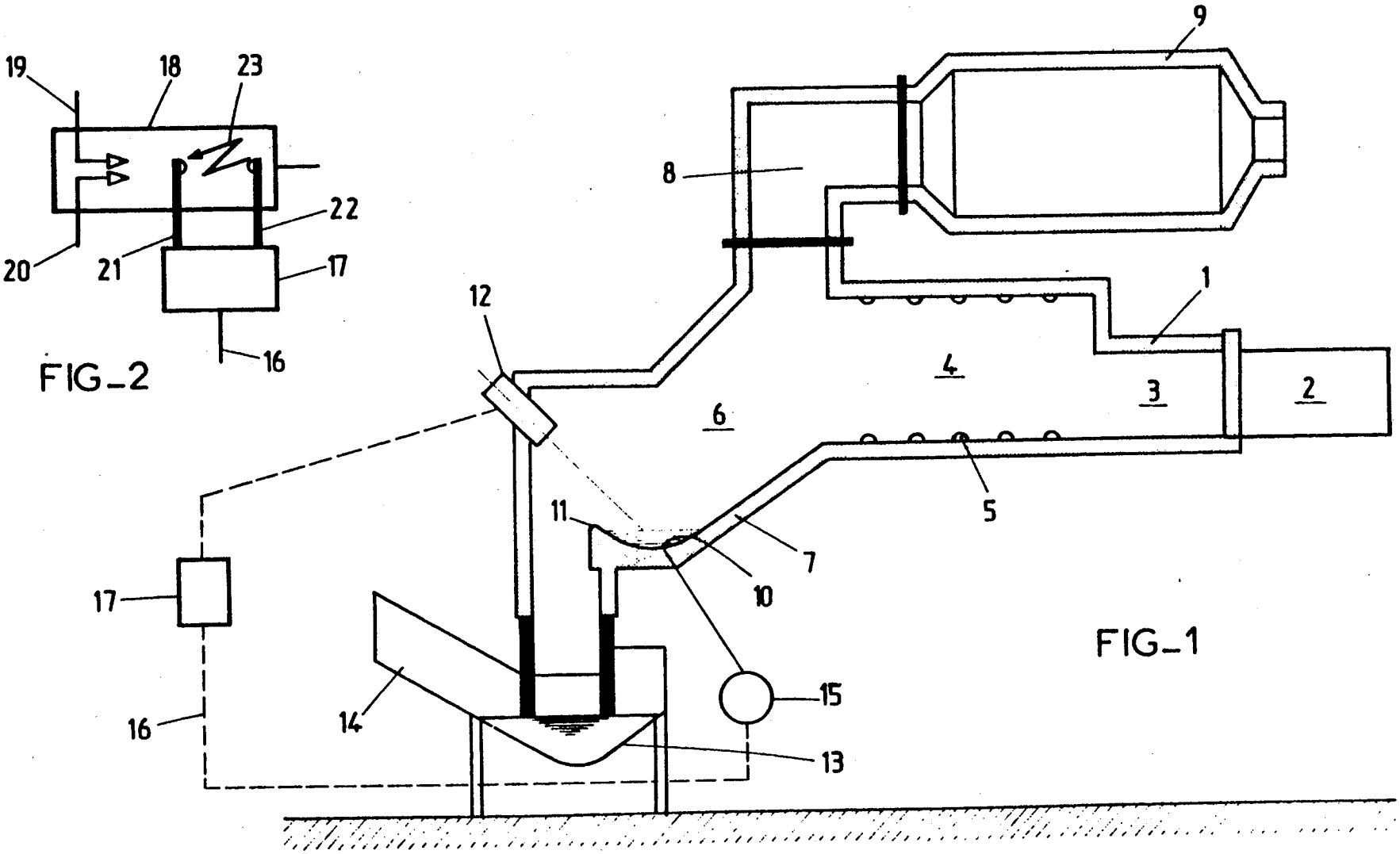
FIG. 1 is a plan of an incinerator according to the invention.
FIG. 2 is a plan of the electroburner of the incinerator in FIG. 1.

The furnace consists of a frame 1 of refractory material which defines essentially the following zones:

A. A charging zone 2 consisting of a sieve or screen, for preventing the entry of cold air, and fitted with a drawer (not shown), for introducing the waste into the following zone 3.

B. This advancing zone 3 enables the waste to be channelled as the furnace is loaded.

C. A combustion zone 4 equipped with air injection nozzles 5.

D. A fusion zone 6 defined by an inclined plane 7 connected to the base of the zone 4 of the furnace.

E. The smoke produced by the combustion, in the zone 4 and in the zone 6, comes out through a smoke release outlet 8, in which the smoke is mixed, before passing into a post-combustion zone 9 into which secondary air is injected if necessary for oxidation and for total destruction of the carbons of the organic matter and various molecules still persisting and liable to cause harm.

The base of the inclined plane 7 defines a hopper 10 equipped with an overflow 11. An electroburner 12 directs its flame over the open surface of the bath of ash and unburnt matter contained in the hopper. This bath overflows through the overflow 11 and falls into a tank 13 filled with water in which the molten magma breaks up into small vitrified pieces under the effect of the brutal thermal shock. An extractor 14 continuously removes these vitrified elements.

A pyrometric temperature probe 15 detects the temperature of the bath contained in the hopper 10 and, by means of an electrical control circuit 16, controls the device 17 for supplying electrical energy to the electroburner 12.

As shown in FIG. 2, the electroburner is made up essentially of two parts. On the one hand, a gas burner 18 having a fuel supply duct 19 and an air supply duct 20 and, on the other hand, a device for supplying electrical energy which essentially comprises two electrodes 21, 22, between which an arc 23 jumps which brings the temperature of the flame from the burner 18 to a level which can be regulated by means of the device 17.

When the lower calorific power of the waste is too low, a combustible product may be added thereto before the waste is introduced into the furnace, or additional energy may be supplied by means of a burner located in the combustion zone.

I claim:

1. Process for incinerating waste by burning it in a furnace at a temperature of about 1000° to 1300° C. in order to obtain smoke and ash and unburnt material, and passing the ash and unburnt material into a bath of ash and unburnt material maintained in the molten state by the heat released by an electroburner.

2. Waste incinerator, comprising a furnace having a waste charging zone, an air insufflation inlet, a smoke release outlet and a charging zone for ash and unburnt material which communicates with an intake hopper for a bath and an electroburner adapted to maintain the bath in the molten state.

3. Incinerator according to claim 2, wherein the bath temperature is maintained at at least 1500° C.

4. Incinerator according to claim 2, wherein the bath temperature is maintained at at least 1700° C.

5. Incinerator according to claim 3, wherein the bath has a surface and the electroburner has a flame and is arranged so that its flame extends close to the surface of the bath.

6. Incinerator according to claim 2, wherein the hopper is below the furnace and the furnace comprises, in the discharge zone, an inclined plane connected to the hopper.

7. Incinerator according to claim 2, wherein the bath spills, through an overflow, into a water tank.

8. Incinerator according to claim 7, wherein the electroburner is closer to the overflow than to the inclined plane.

9. Incinerator according to claim 2, which comprises means for determining the quantity of heat to be supplied by the electroburner and emitting a signal, a device for supplying electrical energy to the electroburner and a control circuit for controlling the energy supplied to the electroburner, as a function of the signal emitted by the determining means.

* * * * *